US011443753B2

(12) United States Patent
Laaksonen

(10) Patent No.: US 11,443,753 B2
(45) Date of Patent: Sep. 13, 2022

(54) AUDIO STREAM DEPENDENCY INFORMATION

(71) Applicant: Nokia Technologies Oy, Espoo (FI)

(72) Inventor: Lasse Juhani Laaksonen, Tampere (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 16/762,557

(22) PCT Filed: Nov. 2, 2018

(86) PCT No.: PCT/EP2018/079980
§ 371 (c)(1),
(2) Date: May 8, 2020

(87) PCT Pub. No.: WO2019/091860
PCT Pub. Date: May 16, 2019

(65) Prior Publication Data

US 2020/0335111 A1 Oct. 22, 2020

(30) Foreign Application Priority Data

Nov. 10, 2017 (GB) ..... 1718583

(51) Int. Cl.
*G10L 19/008* (2013.01)
*G10L 19/16* (2013.01)

(52) U.S. Cl.
CPC ..... *G10L 19/008* (2013.01); *G10L 19/167* (2013.01)

(58) Field of Classification Search
CPC ..... G10L 19/00; G10L 19/008; G10L 19/167; G10L 19/173; G10L 19/16;
(Continued)

(56) References Cited

U.S. PATENT DOCUMENTS

2011/0150227 A1 6/2011 Kim
2011/0173005 A1* 7/2011 Hilpert ..... G10L 19/008 704/500

(Continued)

FOREIGN PATENT DOCUMENTS

EP 2144229 A1 1/2010
GB 2549532 A 10/2017
WO 2010/105695 A1 9/2010

OTHER PUBLICATIONS

"Proposal for IVAS Codec Formats", 3GPP TSG-SA4 #95 Meeting, S4-170938, Agenda: 7.5, Qualcomm Incorporated, Oct. 9-13, 2017, pp. 1-3.

(Continued)

*Primary Examiner* — Leshui Zhang
(74) *Attorney, Agent, or Firm* — Alston & Bird LLP

(57) ABSTRACT

There is disclosed inter alia an apparatus comprising means for receiving an audio format comprising a plurality of individual audio signal streams and metadata, wherein the metadata comprises a dependency field associated with each (Continued)

of the plurality of individual audio signal streams; means for determining that a dependency field associated with a first individual audio signal stream of the plurality of individual audio signal streams indicates that the first individual audio signal stream is related to a second individual audio signal stream of the plurality of individual audio signal streams; and means for encoding the first and second individual audio signal streams as a combined multichannel audio signal by an audio encoder.

19 Claims, 4 Drawing Sheets

(58) Field of Classification Search
CPC ..... H04S 2400/01; H04S 2400/03; H04S 2400/09; H04S 2400/15; H04S 2420/03; H04S 3/02; H04S 3/008; H04R 27/00
USPC ..... 704/500–504, 270, 272, 274, 275, 276, 704/278, E19.01, E19.042, E19.048; 381/1, 2, 15–23, 309, 310, 311, 26, 61, 381/86, 91, 92, 94.2, 94.3, 94.4, 97, 98, 381/103, 119, 122; 700/94
See application file for complete search history.

(56) References Cited

U.S. PATENT DOCUMENTS

2012/0209615 A1* 8/2012 Thesing ..... G10L 19/008 704/500
2013/0272525 A1* 10/2013 Yoo ..... G10L 19/167 381/1
2017/0243590 A1* 8/2017 Fersch ..... G10L 19/018

OTHER PUBLICATIONS

"New WID on EVS Codec Extension for Immersive Voice and Audio Services", 3GPP WG-SA4 Meeting #94 , S4-170749, Agenda: 18, Ericsson LM, Jun. 26-30, 2017, 4 pages.
"3rd Generation Partnership Project; Technical Specification Group Services and System Aspects; Codec for Enhanced Voice Services (EVS); Detailed Algorithmic Description (Release 14)", 3GPP TS 26.445, V14.1.0, Jun. 2017, pp. 1-658.
Search Report received for corresponding United Kingdom Patent Application No. 1718583.6, dated May 11, 2018, 3 pages.
International Search Report and Written Opinion received for corresponding Patent Cooperation Treaty Application No. PCT/EP2018/079980, dated Jan. 18, 2019, 11 pages.
Office Action for European Application No. 18796050.5 dated Apr. 26, 2022, 6 pages.

* cited by examiner

AUDIO STREAM DEPENDENCY INFORMATION

RELATED APPLICATION

This application claims priority to PCT Application No. PCT/EP2018/079980, filed on Nov. 2, 2018, which claims priority to Great Britain Patent Application No. 1718583.6, filed on Nov. 10, 2017, each of which is incorporated herein by reference in its entirety.

FIELD

The present application relates to apparatus and methods for encoding audio and/or speech signals in particular the encoding of multiple audio streams.

BACKGROUND

Spatial audio systems attempt to capture the salient parts of a sound field and reproduce a representation of the captured sound field in some form such that a listener can perceive the spatial characteristics of the original sound scene. A typical audio scene comprising audio events can be captured efficiently by using multiple microphones in an array and spatial audio playback systems, such as commonly used 5.1 channel setup or alternatively binaural signal with headphone listening, can be applied for representing sound sources in different directions. Efficient methods are then used for converting multi-microphone capture into spatial signals resulting in spatial audio playback systems suitable for representing spatial events captured with multi-microphone system.

In order to represent immersive spatial sound, a number of concepts have emerged of which perhaps the currently most common method is to represent spatial sound as a set of waveform streams or channel signals where each signal can be designated to feed a particular loudspeaker in a known prescribed position relative to the listener position.

In view of the above there is an interest in processing multiple individual audio streams, such as those delivered by multiple microphones used to capture an audio scene, and then encoding the multiple individual audio streams by an audio codec. However, the coding complexity of an audio coding algorithm can vary according to the characteristics of the input signal. Furthermore the capacity for an audio codec to handle a multiple of individual audio streams can be limited by the dynamic of the coding complexity of the encoding algorithms. Accordingly the number of audio streams supported by the audio codec will affect the immersive spatial audio experience provided to the listener.

SUMMARY

This invention proceeds from the consideration that it is desirable to be able to encode as many audio streams as possible in order to fully deliver the immersive audio experience to the end user. The algorithmic complexity of the audio codec which is used to encode the individual audio streams of the audio scene is a limiting factor in the processing chain of events required to deliver the audio experience. Consequently it is advantageous to reduce the computational complexity related to the processing of the individual audio streams.

There is provided according to a first aspect a method comprising: receiving an audio format comprising a plurality of individual audio signal streams and metadata, wherein the metadata comprises a dependency field associated with each of the plurality of individual audio signal streams, and wherein the dependency field indicates whether an individual audio signal stream is related to another individual audio signal stream; determining that a dependency field associated with a first individual audio signal stream of the plurality of individual audio signal streams indicates that the first individual audio signal stream is related to a second individual audio signal stream of the plurality of individual audio signal streams; and encoding the first and second individual audio signal streams as a combined multichannel audio signal by an audio encoder.

The metadata may further comprise a dependency field associated with a further individual audio signal stream of the plurality of audio signal streams, wherein the method may further comprise: determining that the dependency field associated with the further individual audio signal stream indicates the further individual audio stream is independent from other individual audio signal streams of the plurality of individual audio signal streams; and encoding the further individual audio stream as a single mono channel audio signal by the audio encoder.

Determining that the dependency field associated with a first individual audio signal stream of the plurality of individual audio signal streams is related to a second individual audio signal stream of the plurality of individual audio signal streams may comprise: determining that the dependency field associated with the first individual audio signal stream has an indicator indicating the second individual audio signal stream.

The metadata may further comprise a numerical identifier for the first individual audio signal stream and a numerical identifier for the second individual audio signal stream.

The indicator indicating the second individual audio signal stream may comprises an indication that the numerical identifier of the second individual audio signal stream is greater than the numerical identifier of the first individual audio signal stream.

The numerical identifier of the second individual audio signal stream is greater than the numerical identifier of the first individual audio signal stream may comprise that the numerical identifier of the second individual audio signal stream has a value which is the value of the numerical identifier increased by one.

The indicator indicating the second individual audio signal stream may comprise an indication that the numerical identifier of the second individual audio signal stream is less than the numerical identifier of the first individual audio signal stream.

The numerical identifier of the second individual audio signal stream is less than the numerical identifier of the first individual audio signal stream may comprise the numerical identifier of the second individual audio signal stream has a value which is the value of the numerical identifier decreased by one.

The indicator indicating the second individual audio signal stream may comprise the numerical identifier of the second individual audio signal stream.

The first individual audio signal stream is related to the second individual audio signal stream may comprise the first individual audio signal stream is substantially correlated to the second individual audio signal stream.

The combined multichannel audio signal may be a stereo audio signal.

The plurality of individual audio signal streams may be captured by a plurality of microphones distributed in an audio scene.

There is provided according to a second aspect an apparatus comprising: means for receiving an audio format comprising a plurality of individual audio signal streams and metadata, wherein the metadata comprises a dependency field associated with each of the plurality of individual audio signal streams, and wherein the dependency field indicates whether an individual audio signal stream is related to another individual audio signal stream; means for determining that a dependency field associated with a first individual audio signal stream of the plurality of individual audio signal streams indicates that the first individual audio signal stream is related to a second individual audio signal stream of the plurality of individual audio signal streams; and means for encoding the first and second individual audio signal streams as a combined multichannel audio signal by an audio encoder.

The metadata may further comprise a dependency field associated with a further individual audio signal stream of the plurality of audio signal streams, wherein the apparatus may further comprise: means for determining that the dependency field associated with the further individual audio signal stream indicates the further individual audio stream is independent from other individual audio signal streams of the plurality of individual audio signal streams; and means for encoding the further individual audio stream as a single mono channel audio signal by the audio encoder.

The means for determining that the dependency field associated with a first individual audio signal stream of the plurality of individual audio signal streams is related to a second individual audio signal stream of the plurality of individual audio signal streams may comprise means for determining that the dependency field associated with the first individual audio signal stream has an indicator indicating the second individual audio signal stream.

The metadata may further comprise a numerical identifier for the first individual audio signal stream and a numerical identifier for the second individual audio signal stream.

The indicator indicating the second individual audio signal stream may comprise an indication that the numerical identifier of the second individual audio signal stream is greater than the numerical identifier of the first individual audio signal stream.

The numerical identifier of the second individual audio signal stream is greater than the numerical identifier of the first individual audio signal stream may comprise the numerical identifier of the second individual audio signal stream has a value which is the value of the numerical identifier increased by one.

The indicator indicating the second individual audio signal stream may comprise an indication that the numerical identifier of the second individual audio signal stream is less than the numerical identifier of the first individual audio signal stream.

The numerical identifier of the second individual audio signal stream is less than the numerical identifier of the first individual audio signal stream may comprise the numerical identifier of the second individual audio signal stream has a value which is the value of the numerical identifier decreased by one.

The indicator indicating the second individual audio signal stream may comprise the numerical identifier of the second individual audio signal stream.

The first individual audio signal stream is related to the second individual audio signal stream may comprise the first individual audio signal stream is substantially correlated to the second individual audio signal stream.

The combined multichannel audio signal may be a stereo audio signal.

The plurality of individual audio signal streams are captured by a plurality of microphones distributed in an audio scene.

According to another aspect there is provided an apparatus comprising at least one processor and at least one memory including computer program code, the at least one memory and the computer program code configured to, with the at least one processor, cause the apparatus to: receive an audio format comprising a plurality of individual audio signal streams and metadata, wherein the metadata comprises a dependency field associated with each of the plurality of individual audio signal streams, and wherein the dependency field indicates whether an individual audio signal stream is related to another individual audio signal stream; determine that a dependency field associated with a first individual audio signal stream of the plurality of individual audio signal streams indicates that the first individual audio signal stream is related to a second individual audio signal stream of the plurality of individual audio signal streams; and encode the first and second individual audio signal streams as a combined multichannel audio signal by an audio encoder.

The metadata may further comprise a dependency field associated with a further individual audio signal stream of the plurality of audio signal streams, wherein the apparatus may be further caused to: determine that the dependency field associated with the further individual audio signal stream indicates the further individual audio stream is independent from other individual audio signal streams of the plurality of individual audio signal streams; and encode the further individual audio stream as a single mono channel audio signal by the audio encoder.

The apparatus caused to determine that the dependency field associated with a first individual audio signal stream of the plurality of individual audio signal streams is related to a second individual audio signal stream of the plurality of individual audio signal streams may be caused to determine that the dependency field associated with the first individual audio signal stream has an indicator indicating the second individual audio signal stream.

The metadata may further comprise a numerical identifier for the first individual audio signal stream and a numerical identifier for the second individual audio signal stream.

The indicator indicating the second individual audio signal stream may comprise an indication that the numerical identifier of the second individual audio signal stream is greater than the numerical identifier of the first individual audio signal stream.

The numerical identifier of the second individual audio signal stream is greater than the numerical identifier of the first individual audio signal stream may comprise the numerical identifier of the second individual audio signal stream has a value which is the value of the numerical identifier increased by one.

The indicator indicating the second individual audio signal stream may comprise an indication that the numerical identifier of the second individual audio signal stream is less than the numerical identifier of the first individual audio signal stream.

The numerical identifier of the second individual audio signal stream is less than the numerical identifier of the first individual audio signal stream may comprise the numerical identifier of the second individual audio signal stream has a value which is the value of the numerical identifier decreased by one.

The indicator indicating the second individual audio signal stream may comprise the numerical identifier of the second individual audio signal stream.

The first individual audio signal stream is related to the second individual audio signal stream may comprise the first individual audio signal stream is substantially correlated to the second individual audio signal stream.

The combined multichannel audio signal may be a stereo audio signal.

The plurality of individual audio signal streams are captured by a plurality of microphones distributed in an audio scene.

According to yet another aspect there is provided a computer program code realizing the following when executed by a processor: receiving an audio format comprising a plurality of individual audio signal streams and metadata, wherein the metadata comprises a dependency field associated with each of the plurality of individual audio signal streams, and wherein the dependency field indicates whether an individual audio signal stream is related to another individual audio signal stream; determining that a dependency field associated with a first individual audio signal stream of the plurality of individual audio signal streams indicates that the first individual audio signal stream is related to a second individual audio signal stream of the plurality of individual audio signal streams; and encoding the first and second individual audio signal streams as a combined multichannel audio signal by an audio encoder.

SUMMARY OF THE FIGURES

For a better understanding of the present application, reference will now be made by way of example to the accompanying drawings in which.

EMBODIMENTS OF THE APPLICATION

The following describes in further detail suitable apparatus and possible mechanisms for the provision of effective processing of multiple individual audio streams by an audio codec, of which a particular application is the delivery of a spatial immersive audio experience. In the following examples, audio signals and audio capture signals are described. However it would be appreciated that in some embodiments the apparatus may be part of any suitable electronic device or apparatus configured to capture an audio signal or receive the audio signals and other information signals.

Figure 1:
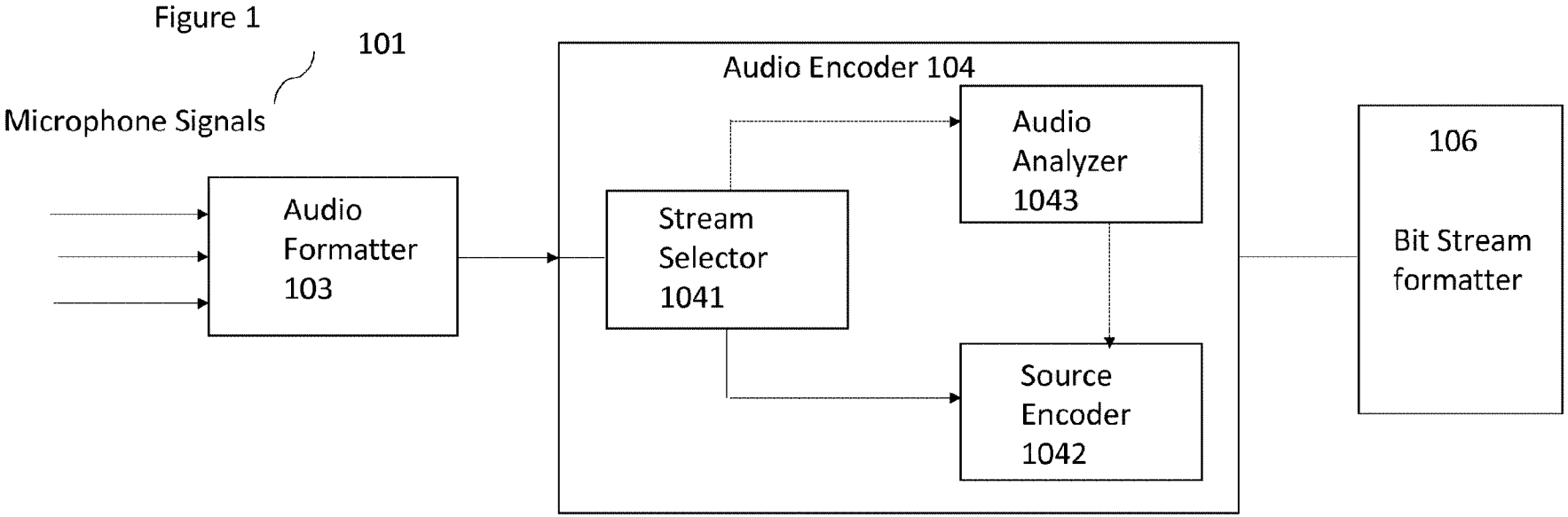
FIG. 1 shows schematically an audio processing system according to embodiments.
Figure 3:
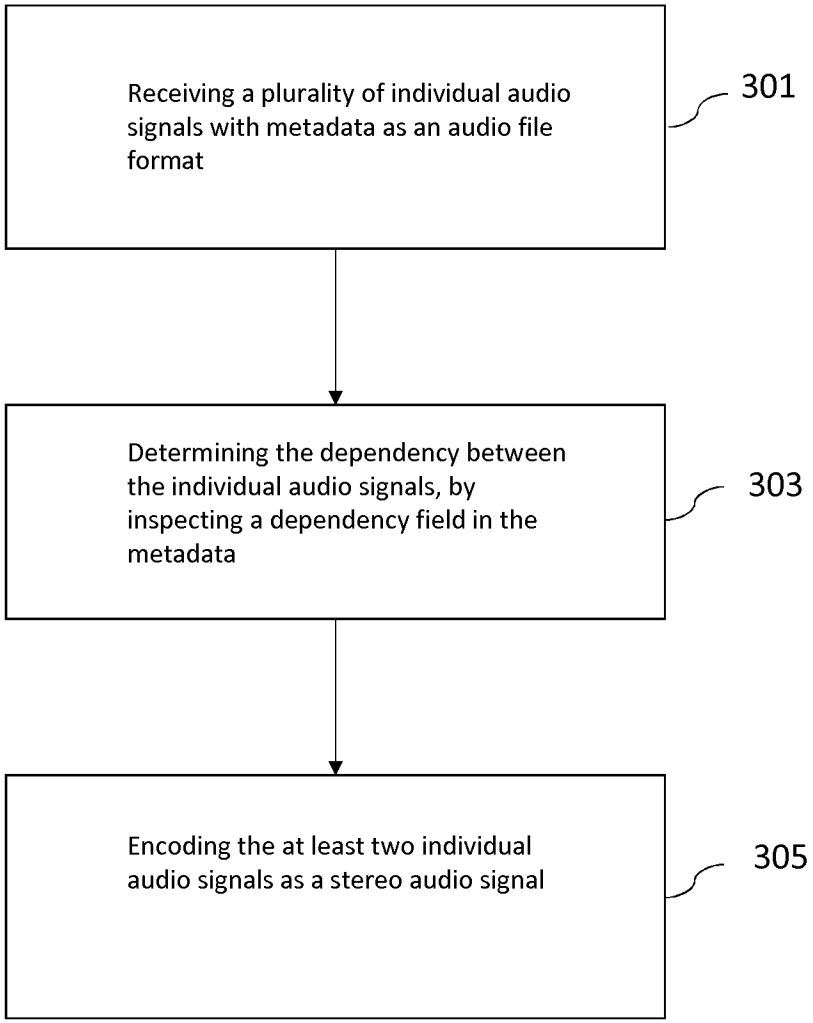
FIG. 3 shows a flow diagram of a process performed by the audio processing system of FIG. 1.

FIG. 1 thus shows an audio signal processing system which receives the inputs from at least two microphones, and the FIG. 3 depicts the operations performed on the received audio signals received by the audio signal processing system. In FIG. 1 three microphone audio signals are shown as an example microphone audio signal input however any suitable number of microphone audio signals may be used). Each of the microphone audio signals 101 can form an input to the audio formatter 103. The audio formatter 103 can form an individual audio stream for each microphone signal in order to form an audio format. In embodiments an audio format may be a package of a number of individual audio streams. In this case each individual audio stream can be associated with the output from a microphone, in which the set of microphones capture the audio scene. However, in other embodiments the individual audio streams may be unrelated to each other to the extent that a first audio stream can be the output from a microphone and a further audio stream may be a music signal from a database such as a musical track archive or an individual audio stream from another audio formatter.

In some embodiments the individual audio streams may be packaged or encapsulated together with other forms of representation of the audio scene such as first order and higher order ambisonics or a parametric audio approach that includes metadata describing at least audio source directions.

The audio format may be a file format which is used to hold or collate the plurality of individual audio streams. In some instances the individual audio streams may have a dependency on each other, in other words there may be a degree of correlation exhibited between the various individual audio streams contained under the "umbrella" of the audio format. In some embodiments the dependency can be attributed to the capture of a particular audio scene by an array of microphones.

Encompassed within the audio format, or associated with each of the individual audio streams, there may be metadata which is used to convey particular information about the individual audio streams to the audio codec. In particular the metadata may be used to assist the audio codec in the process of encoding the plurality of individual audio streams. In this instance the audio format as formatted by the audio formatter 103 may be termed as Individual Streams with Metadata (ISM) format.

In embodiments metadata may be audio related metadata relevant for the playback of the audio content captured as the individual audio streams. In particular the metadata may contain data for controlling a rendering process in a playback system and may contain information relating to the spatial characteristics of the individual audio streams. Such data may comprise information on the azimuth and elevation (or any other type of spatial direction representation) of each individual audio stream which can be used to assist in the rendering of the individual audio streams in the spatial audio playback system.

As mentioned above at least two of the individual audio streams may be "related" to each other, for instance they may each be derived from an individual microphone covering a particular sector within the same acoustic space or the same audio scene. In this case the individual audio streams can have a dependency to each other which may be reflected by the individual audio streams having a degree of correlation with each other.

In embodiments the dependency information may form part of the metadata set which is encompassed in the audio format. Thereby when the audio format comprising the individual audio streams and metadata is presented to the audio codec the dependency information can be used by the audio codec to assist in the encoding of the plurality of individual audio streams.

The dependency information can be added or updated as part of the audio format creation stage in the audio formatter 103, at the point when the individual audio streams are captured, or at another point in the audio creation stream. The audio formatter 103 can therefore initialize the dependency information with the apriori relationship between the individual audio streams encapsulated by the audio format.

In other words the dependency information is updated by the audio formatter 103 with apriori knowledge of the captured audio streams. For example, in the instance that the individual audio streams are the output from an array of multiple microphones capturing a specific audio scene, then the dependency information may be initialized by the audio formatter 103 with apriori data to indicate that all the individual audio streams are related to the same audio scene. However, in the instance that the individual audio streams are from different audio scenes that are unrelated then the dependency information may be initialized by the audio formatter 103 with apriori data to indicate that the streams are unrelated to each other, in other words there is no dependency between the streams. For example, one audio stream may be a captured microphone signal on a user device for a particular audio scene, and another audio stream may be a captured microphone signal from a completely unrelated audio scene. In this case the dependency data would reflect the apriori knowledge that the audio streams encapsulated within the audio format are unrelated to each other.

In some embodiments the dependency data may be updated in the metadata structure upstream from the audio formatter 103. This may take the form of updating the metadata structure at the capture stage whereby the dependency data may be set based on the capture device settings or user input. In some cases the dependency data may be set conditional on input from a separate audio analysis device which can be arranged to perform a correlation based analysis on a number of captured individual audio streams. In some instances the dependency data may be set upon the conditions of the capture. For example a beamforming operation may be applied to the microphone signals during the capture of an audio scene in order to emphasize the signals captured from a particular direction. Such operations can result in individual audio streams of the audio scene not being related to each other to the extent that the individual audio streams exhibit very little correlative behavior with each other. In this example the dependency data can be set to show that the individual audio streams are not related to each other. In other words the individual audio streams are not correlated to each other.

In embodiments the dependency data can be in the form of a data field of the metadata structure.

The dependency data field of the metadata within the audio format may also be configured to indicate whether a particular sub set of the individual audio streams encapsulated by the audio format are related to each other, and whether certain other individual audio streams encapsulated by the audio format are unrelated. In other words the dependency data field may be viewed as a structure comprising a number of indicators, with each indicator signaling whether a particular individual audio stream has a dependency to another individual audio stream within the file format.

Figure 2:
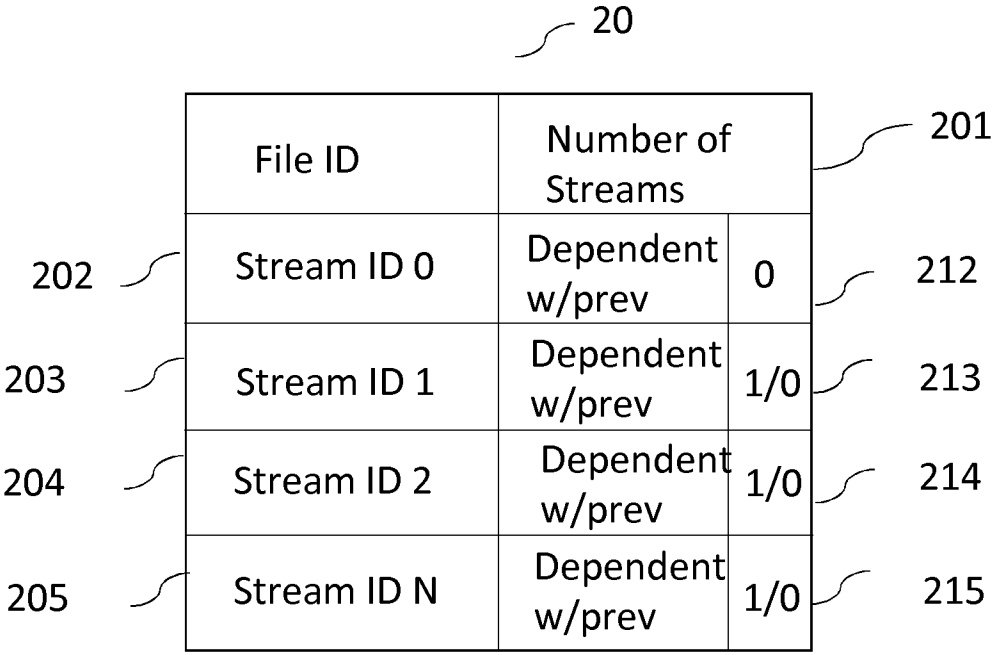
FIG. 2 shows schematically an example metadata structure

FIG. 2 depicts one form of metadata structure 20 which can be used to indicate the apriori relationship between a number of individual audio streams encapsulated within an audio format. In this example the field 201 indicates the number of individual audio streams which is within the scope of the metadata structure. The scope of the metadata structure can encompass all the individual audio streams within the audio format, or it can encompass a sub set of the total individual audio streams within the audio format. In this example, the metadata structure fields 202, 203, 204 and 205 each indicate a particular identifier associated with a particular individual audio stream, in other words the aforementioned fields are each an individual audio stream ID. Associated with each individual audio stream ID there is a field 212, 213, 214, 215 which indicates whether the individual audio stream associated with its respective ID is related or has a dependency with the previous individual audio stream in descending numerical order of stream ID. For example in FIG. 2 stream ID 1 203 as a dependency identifier 213 which indicates whether stream ID 1 203 is related to Stream ID 0 202. In embodiments each dependency identifier can be a bit where the state of the bit indicates whether there is a relationship between individual audio streams. For example, in this instance "1" can indicate if stream with ID 1 is related to a stream with ID 0, and a "0" indicates that stream with ID 1 is not related or has no dependency to the stream with ID 1.

It is to be appreciated that this structure allows to arrange the individual audio streams such that any combination of the dependencies between the at least two individual audio streams can be communicated via the dependency metadata field 212, 213, 214, 215 corresponding to each of the individual audio streams.

Further implementations of the above metadata structure can have dependency identifiers which indicate whether a respective individual audio stream is related to a following individual audio stream. For example using the labelling introduced in FIG. 2, the stream ID 1 203 can have a dependency identifier which indicates whether the audio stream is related to stream ID 2 204 the following individual audio stream.

Other implementations of the above metadata structure can have a dependency identifier which directly references the stream ID of the individual audio stream to which it refers. Again using the above terminology of FIG. 2 the individual audio stream identifier stream ID 0 202 can have a dependency identifier 212 which directly identifiers the related stream. For instance the dependency identifier 212 may be initialized with the apriori information of 3 which would indicate that stream ID 0 is related to stream ID 3.

Still further implementations may be arranged to have a 2 bit dependency identifier associated with each individual audio stream identifier. This can be used to record the following dependency identifier options: the individual audio stream associated with a particular stream ID is independent, in other words the individual audio stream exhibits very little correlation with other individual audio streams within the scope of the metadata structure; the individual audio stream is related to the previous individual audio stream in numerical ascending order of stream ID, in other words there is correlative behavior between the two individual audio streams; the individual audio stream is related to the next individual audio stream in numerical ascending order of stream; finally the fourth bit state may comprise the notification of an escape code. The escape code may be used to point to a further data field in the metadata structure which signifies a stream ID value to which the individual audio stream is related.

It is to be appreciated that the term related can be used to mean within the context of individual audio streams that there is a degree of correlation between two or more individual audio streams.

The processing step of receiving a plurality of individual audio signals with accompanying metadata as an audio file format is shown in FIG. 3 as step 301. This step may be performed as part of the audio encoder 104 and implemented on a processing device 1200 shown in FIG. 4.

The output from the audio formatter 102, in other words the encapsulated audio data comprising the individual audio streams with metadata, can be passed as an input to the audio encoder 104. Within the audio encoder 104 the encapsulated audio from the audio formatter 102 can be received by a stream selector 1041 which is arranged to select particular individual audio streams, based on the metadata, for subsequent encoding by the source encoder 1042.

The stream selector 1041 can be arranged to classify the individual audio streams of the audio format according to the included metadata structure with dependency information as described above. The classification of the individual audio streams is then used to drive the following source encoding stage as performed by the source encoder 1042. With this in mind one of the main factors which drives the following source encoding stage is the level of complexity required by the source encoder 1042 to encode the audio individual audio streams.

In embodiments the stream selector 1041 can use the dependency information conveyed with the metadata structure to determine whether any of the individual audio streams can be treated as correlated multichannel input signals by the source encoder 1042. For instance the stream selector 1041 may be arranged to classify pairs of the individual audio streams as stereo channel pair elements (CPE/stereo), which may then be subsequently processed by the source encoder 1042 as a stereo input signal. Within the stream selector 1041 this may be performed by inspecting the dependency data field in the metadata structure for individual audio streams which are related. Accordingly, individual audio streams which have a metadata dependency field entry that indicates the stream is unrelated to other individual audio streams in the audio format can be classified as mono single channel elements (SCE/mono). In this situation the source encoder 1042 will treat the input audio stream as a mono stream.

The overall processing step of determining the dependency between the plurality of received individual audio signals by inspecting the dependency field in the accompanying metadata is shown in FIG. 3 as step 303. This step may be performed as part of the audio encoder 104 in particular it may be performed by the stream selector 1041 and can be implemented on a processing device 1200 shown in FIG. 4.

Within the audio encoder 104 there is also shown an audio analyzer 1043 which may be arranged to further analyze the individual audio streams of the audio format. In embodiments the audio analyzer 1043 can be used to analyze the correlation characteristics between individual audio streams which have a metadata dependency filed indicating that they are unrelated to other audio streams in the audio format. For instance these individual audio streams may each be captured in different audio scenes. In these embodiments the correlation characteristics of such streams are checked in order to ascertain whether the individual audio streams can be classified as being related. If it is determined that the analyzed audio streams can be classified as being related then the streams can be treated as a correlated multichannel audio signal such as stereo channel pair elements (CPE/stereo). This therefore can result in the multiple individual audio stream being handled by the source encoder 1042 as a multichannel input signal such as a stereo channel pair.

It is to be appreciated that the individual audio stream classification process which is performed by either the stream selector 1041 using the metadata contained as part of the audio format or the further audio analyzer 1043 can result in an overall complexity reduction or a source coding bit rate allocation optimization within the audio encoder 104. The complexity reduction can be a direct consequence of pre-classifying the independent audio streams before the process of encoding the waveforms as undertaken by the source encoder 1042. For instance if some of the individual audio streams are classified as being related to each other rather than being classified as being non related, then the related individual audio streams can be encoded by the source encoder 1042 as related multichannel audio signal. For example, in the case of a pair of individual audio streams being classified as being related, then the pair of streams is classified as a stereo channel pair and consequently the source encoder 1042 will encode it as such. However, if a pair of individual audio streams are classified as being individual from each other, in other words unrelated, then the pair individual audio streams will be encoded by the source encoder 1042 as two individual single channel elements. Typically a source encoder 1042 will be able to process a stereo channel signal more efficiently than two mono channel signals. Furthermore a source encoder 1042 can encode a stereo channel signal using less bits than two mono channel signals.

By using the above approach of pre classifying individual audio streams before encoding can result in the further effect of improving the spatial immersive experience to the end user, since individual audio streams are likely to be classified as being related to each other especially if they have all been captured from the same audio scene. Consequently, the individual audio streams can be handled by the source encoder 1042 as a series of correlated multichannel audio channel signals where the encoder algorithms can exploit the relationship between the channels during the encoding process. Thereby resulting in less processing complexity on a per channel basis which in turn results in an increase in the capacity of the number of spatial audio immersive channels which can be processed by the audio encoder 104. Furthermore, the algorithm may avoid the additional computational complexity related to a classification step, when the associated classification output is provided to the audio encoder 104 via metadata.

In embodiments the source encoder 1042 may include the form of the Codec for Enhanced Voice Service in accordance with the 3rd Generation Partnership (3GPP) standard 3GPP TS 26.445. The above reference is incorporated in its entirety herein. However, it is to be appreciated that the above source encoder 1042 can be any suitable select audio encoder such as the MPEG-4 Advanced Audio Codec (AAC) or Adaptive Multirate Wideband plus (AMR-WB+) codec.

The processing step of encoding the plurality of individual audio signals is shown in FIG. 3 as step 303. This step may be performed as part of the audio encoder 104 in particular the source encoder 1042 and implemented on a processing device 1200 shown in FIG. 4.

With reference to FIG. 2, the output from the audio encoder 104 which can comprise the encoded individual audio streams as a bit stream can be passed to a bit stream formatter 106. Additionally the bit stream formatter 106 may also merge additional bit streams formed from spatial metadata which can be used to assist in the rendering of the synthetic audio scene by a spatial audio playback system.

Furthermore the bit stream formatter 106 may also be arranged to include into the bit stream the metadata structure with the individual audio stream dependency information as described above. This would allow any decoder in a spatial audio playback system direct access to the dependency information used to originally encode the plurality of individual audio streams.

The bit stream formatter 106 in some embodiments may interleave the received inputs and may generate error detecting and error correcting codes to be inserted into the bit stream output. Additionally, the bit stream formatter 106 may also may convert the bit stream output into RTP packets for transmission over an IP based network.

It is to be appreciated that the dependency metadata as described above as the technical effect or technical advantage of encoding dependent individual audio streams, such as audio objects or channel signals that are known to exhibit correlation, as combined multichannel audio representations, whilst independent individual audio streams, such as audio objects and channel signals that are known to exhibit only low correlation or are desired to be treated such, as separate mono audio representations.

For the methods presented herein, it is in practice not relevant if the audio signals and/or the spatial metadata are obtained from the microphone signals directly, or indirectly, for example, via microphone array spatial processing or through encoding, transmission/storing and decoding. With respect to FIG. 4 an example electronic device 1200 which may be used as at least part of the capture and/or a playback apparatus is shown. The device may be any suitable electronics device or apparatus. For example in some embodiments the device 1200 is a virtual or augmented reality capture device, a mobile device, user equipment, tablet computer, computer, connected headphone device, a smart speaker and immersive capture solution, audio playback apparatus, etc.

The device 1200 may comprise a microphone array 1201. The microphone array 1201 may comprise a plurality (for example a number M) of microphones. However it is understood that there may be any suitable configuration of microphones and any suitable number of microphones. In some embodiments the microphone array 1201 is separate from the apparatus and the audio signals transmitted to the apparatus by a wired or wireless coupling.

The microphones may be transducers configured to convert acoustic waves into suitable electrical audio signals. In some embodiments the microphones can be solid state microphones. In other words the microphones may be capable of capturing audio signals and outputting a suitable digital format signal. In some other embodiments the microphones or microphone array 1201 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphones can in some embodiments output the audio captured signal to an analogue-to-digital converter (ADC) 1203.

The device 1200 may further comprise an analogue-to-digital converter 1203. The analogue-to-digital converter 1203 may be configured to receive the audio signals from each of the microphones in the microphone array 1201 and convert them into a format suitable for processing. In some embodiments where the microphones are integrated microphones the analogue-to-digital converter is not required. The analogue-to-digital converter 1203 can be any suitable analogue-to-digital conversion or processing means. The analogue-to-digital converter 1203 may be configured to output the digital representations of the audio signals to a processor 1207 or to a memory 1211.

In some embodiments the device 1200 comprises at least one processor or central processing unit 1207. The processor 1207 can be configured to execute various program codes. The implemented program codes can comprise, for example, SPAC analysis, beamforming, spatial synthesis and encoding of individual audio signal streams based on a dependency metadata as described herein.

In some embodiments the device 1200 comprises a memory 1211. In some embodiments the at least one processor 1207 is coupled to the memory 1211. The memory 1211 can be any suitable storage means. In some embodiments the memory 1211 comprises a program code section for storing program codes implementable upon the processor 1207. Furthermore in some embodiments the memory 1211 can further comprise a stored data section for storing data, for example data that has been processed or to be processed in accordance with the embodiments as described herein. The implemented program code stored within the program code section and the data stored within the stored data section can be retrieved by the processor 1207 whenever needed via the memory-processor coupling.

In some embodiments the device 1200 comprises a user interface 1205. The user interface 1205 can be coupled in some embodiments to the processor 1207. In some embodiments the processor 1207 can control the operation of the user interface 1205 and receive inputs from the user interface 1205. In some embodiments the user interface 1205 can enable a user to input commands to the device 1200, for example via a keypad, gestures, or voice commands. In some embodiments the user interface 205 can enable the user to obtain information from the device 1200. For example the user interface 1205 may comprise a display configured to display information from the device 1200 to the user. The user interface 1205 can in some embodiments comprise a touch screen or touch interface capable of both enabling information to be entered to the device 1200 and further displaying information to the user of the device 1200.

In some implements the device 1200 comprises a transceiver 1209. The transceiver 1209 in such embodiments can be coupled to the processor 1207 and configured to enable a communication with other apparatus or electronic devices, for example via a wireless communications network. The transceiver 1209 or any suitable transceiver or transmitter and/or receiver means can in some embodiments be configured to communicate with other electronic devices or apparatus via a wire or wired coupling.

The transceiver 1209 can communicate with further apparatus by any suitable known communications protocol. For example in some embodiments the transceiver 1209 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the device 1200 may be employed as a synthesizer apparatus. As such the transceiver 1209 may be configured to receive the audio signals and determine the spatial metadata such as position information and ratios, and generate a suitable audio signal rendering by using the processor 1207 executing suitable code. The device 1200 may comprise a digital-to-analogue converter 1213. The digital-to-analogue converter 1213 may be coupled to the processor 1207 and/or memory 1211 and be configured to convert digital representations of audio signals (such as from the processor 1207 following an audio rendering of the audio signals as described herein) to a suitable analogue format suitable for presentation via an audio subsystem output. The digital-to-analogue converter (DAC) 1213 or signal processing means can in some embodiments be any suitable DAC technology.

Figure 4:
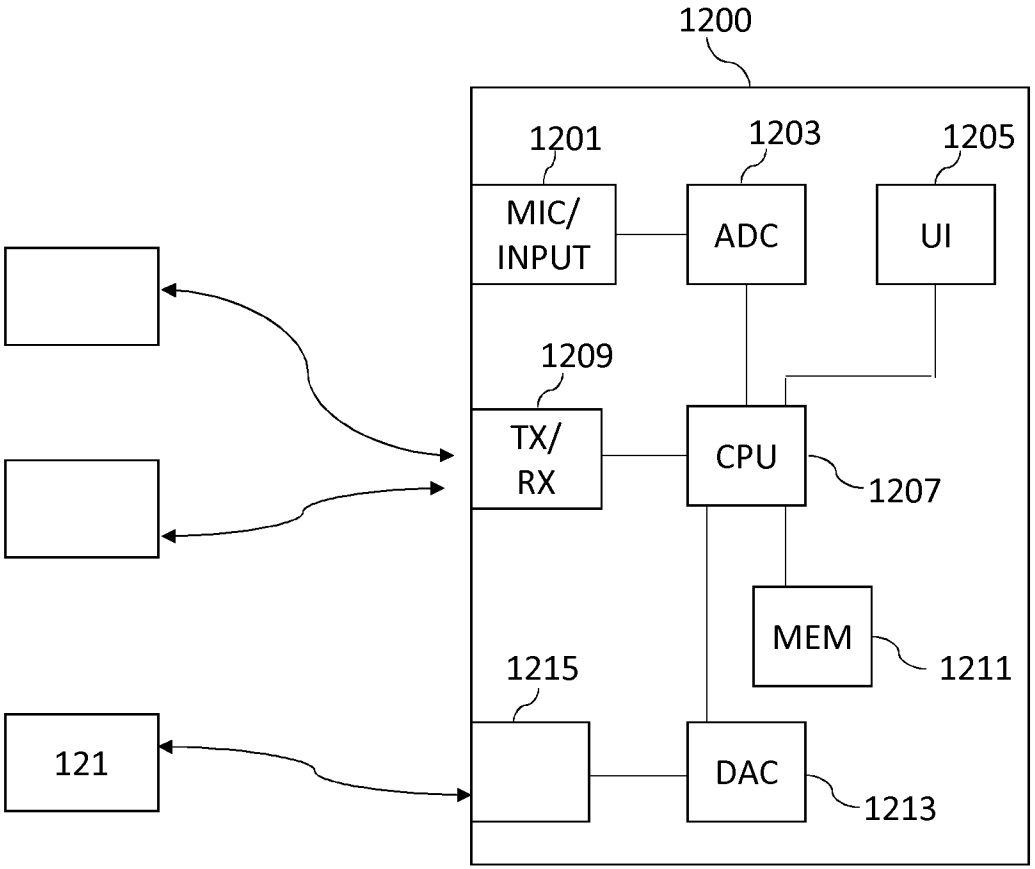
FIG. 4 shows schematically an example electronic apparatus suitable for implementing embodiments.

Furthermore the device 1200 can comprise in some embodiments an audio subsystem output 1215. An example, such as shown in FIG. 4, may be where the audio subsystem output 1215 is an output socket configured to enabling a coupling with headphones 121. However the audio subsystem output 1215 may be any suitable audio output or a connection to an audio output. For example the audio subsystem output 1215 may be a connection to a multichannel speaker system.

In some embodiments the digital to analogue converter 1213 and audio subsystem 1215 may be implemented within a physically separate output device. For example the DAC 1213 and audio subsystem 1215 may be implemented as cordless earphones communicating with the device 1200 via the transceiver 1209.

Although the device 1200 is shown having both audio capture and audio rendering components, it would be understood that in some embodiments the device 1200 can comprise just the audio capture or audio render apparatus elements.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the electronic device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising at least one processor and at least one memory including computer program code, the at least one memory and the computer program code configured to, with the at least one processor, cause the apparatus to:

receive an audio format comprising a plurality of individual audio signal streams and metadata, wherein the metadata comprises a dependency field associated with each of the plurality of individual audio signal streams, and wherein the dependency field indicates whether an individual audio signal stream of the plurality of individual audio signal streams and another individual audio signal stream of the plurality of individual audio signal streams were captured from one or more microphones in a same audio scene or captured from one or more microphones in different audio scenes;

determine that a dependency field associated with a first individual audio signal stream of the plurality of individual audio signal streams indicates that the first individual audio signal stream and a second individual audio signal stream of the plurality of individual audio signal streams were captured from one or more microphones in the same audio scene; and in response to determining that the dependency field indicates that the first individual audio signal stream and the second individual audio signal stream of the plurality of individual audio signal streams were captured from the one or more microphones in the same audio scene, encode the first and second individual audio signal streams as a combined multichannel audio signal by an audio encoder.

2. The apparatus as claimed in claim 1, wherein the metadata further comprises a dependency field associated with a further individual audio signal stream of the plurality of audio signal streams, wherein the apparatus is further caused to:

determine that the dependency field associated with the further individual audio signal stream indicates the further individual audio stream is independent from other individual audio signal streams of the plurality of individual audio signal streams; and encode the further individual audio stream as a single mono channel audio signal by the audio encoder.

3. The apparatus as claimed in claim 1, wherein the apparatus caused to determine that the dependency field associated with the first individual audio signal stream of the plurality of individual audio signal streams indicates the first individual audio signal stream and the second individual audio signal stream of the plurality of individual audio signal streams were captured from one or more microphones in a same audio scene is further caused to:

determine that the dependency field associated with the first individual audio signal stream has an indicator indicating the second individual audio signal stream.

4. The apparatus as claimed in claim 3, wherein the metadata further comprises a numerical identifier for the first individual audio signal stream and a numerical identifier for the second individual audio signal stream.

5. The apparatus as claimed in claim 4, wherein the indicator indicating the second individual audio signal stream comprises an indication that the numerical identifier of the second individual audio signal stream is greater than the numerical identifier of the first individual audio signal stream.

6. The apparatus as claimed in claim 5, wherein the numerical identifier of the second individual audio signal stream has a value which is the value of the numerical identifier of the first audio signal stream increased by one.

7. The apparatus as claimed in claim 4, wherein the numerical identifier of the second individual audio signal stream is less than the numerical identifier of the first individual audio signal stream.

8. The apparatus as claimed in claim 7, wherein the numerical identifier of the second individual audio signal stream has a value which is the value of the numerical identifier of the first individual audio signal stream decreased by one.

9. The apparatus as claimed in claim 4, wherein the indicator indicating the second individual audio signal stream comprises the numerical identifier of the second individual audio signal stream.

10. The apparatus as claimed in claim 1, wherein the combined multichannel audio signal is a stereo audio signal.

11. The apparatus as claimed in claim 1, wherein the plurality of individual audio signal streams are captured by a plurality of microphones distributed in an audio scene.

12. A method comprising:

receiving an audio format comprising a plurality of individual audio signal streams and metadata, wherein the metadata comprises a dependency field associated with each of the plurality of individual audio signal streams, and wherein the dependency field indicates whether an individual audio signal stream of the plurality of individual audio signal streams and another individual audio signal stream of the plurality of individual audio signal streams were captured from one or more microphones in a same audio scene or captured from one or more microphones in different audio scenes;

determining that a dependency field associated with a first individual audio signal stream of the plurality of individual audio signal streams indicates that the first individual audio signal stream and a second individual audio signal stream of the plurality of individual audio signal streams were captured from one or more microphones in the same audio scene; and in response to determining that the dependency field indicates that the first individual audio signal stream and the second individual audio signal stream of the plurality of individual audio signal streams were captured from the one or more microphones in the same audio scene, encoding the first and second individual audio signal streams as a combined multichannel audio signal by an audio encoder.

13. The method as claimed in claim 12, wherein the metadata further comprises a dependency field associated with a further individual audio signal stream of the plurality of audio signal streams, wherein the method further comprises:

determining that the dependency field associated with the further individual audio signal stream indicates the further individual audio stream is independent from other individual audio signal streams of the plurality of individual audio signal streams; and encoding the further individual audio stream as a single mono channel audio signal by the audio encoder.

14. The method as claimed in claim 12, wherein determining that the dependency field associated with the first individual audio signal stream of the plurality of individual audio signal streams indicates that the first individual audio signal stream and the second individual audio signal stream of the plurality of individual audio signal streams were captured from one or more microphones in the same audio scene comprises:

determining that the dependency field associated with the first individual audio signal stream has an indicator indicating the second individual audio signal stream.

15. The method as claimed in claim 14, wherein the metadata further comprises a numerical identifier of the first individual audio signal stream and a numerical identifier of the second individual audio signal stream.

16. The method as claimed in claim 15, wherein the indicator indicating the second individual audio signal stream comprises an indication that the numerical identifier of the second individual audio signal stream is greater than the numerical identifier of the first individual audio signal stream.

17. The method as claimed in claim 16, wherein the numerical identifier of the second individual audio signal stream has a value which is the value of the numerical identifier increased by one.

18. The method as claimed in claim 15, wherein the indicator indicating the second individual audio signal stream comprises an indication that the numerical identifier of the second individual audio signal stream is less than the numerical identifier of the first individual audio signal stream.

19. The apparatus as claimed in claim 18, wherein the numerical identifier of the second individual audio signal stream has a value which is the value of the numerical identifier decreased by one.

* * * * *